US012140058B2

(12) United States Patent
Ke et al.

(10) Patent No.: US 12,140,058 B2
(45) Date of Patent: Nov. 12, 2024

(54) ENGINE END COVER INTEGRATED OIL PUMP ASSEMBLY

(71) Applicant: ZHEJIANG KEBODA INDUSTRY CORP., Zhejiang (CN)

(72) Inventors: Jianhao Ke, Zhejiang (CN); Zhanxun Li, Zhejiang (CN); Pijin Wan, Zhejiang (CN)

(73) Assignee: ZHEJIANG KEBODA INDUSTRY CORP., Zhejiang (CN)

( * ) Notice: Subject to any disclaimer, the term of this patent is extended or adjusted under 35 U.S.C. 154(b) by 0 days.

(21) Appl. No.: 18/700,576

(22) PCT Filed: Jul. 22, 2022

(86) PCT No.: PCT/CN2022/107519

§ 371 (c)(1),
(2) Date: Apr. 11, 2024

(87) PCT Pub. No.: WO2023/138016

PCT Pub. Date: Jul. 27, 2023

(65) Prior Publication Data

US 2024/0337205 A1 Oct. 10, 2024

(30) Foreign Application Priority Data

Jan. 24, 2022 (CN) ..... 202210080576.8

(51) Int. Cl.
*F01M 1/02* (2006.01)

(52) U.S. Cl.
CPC ..... *F01M 1/02* (2013.01); *F01M 2001/0238* (2013.01); *F01M 2001/0269* (2013.01)

(58) Field of Classification Search
CPC ..... F01M 1/02; F01M 2001/0238; F01M 2001/0253; F01M 2001/0269;
(Continued)

(56) References Cited

U.S. PATENT DOCUMENTS 3,520,022 A * 7/1970 Lehner ..... F16H 3/02 425/173
4,411,227 A * 10/1983 Feichtinger ..... F01M 1/02 123/198 C (Continued)

FOREIGN PATENT DOCUMENTS

CN 102071985 A 5/2011
CN 109441657 A 3/2019

(Continued)

OTHER PUBLICATIONS

International Search Report and Written Opinion issued in PCT/CN2022/107519, dated Oct. 10, 2022, with English translation, 15 pages provided.

*Primary Examiner* — Minh Truong
(74) *Attorney, Agent, or Firm* — HSML P. C.

(57) ABSTRACT

An engine end cover integrated oil pump assembly comprises an engine end cover, an oil pump, a crankshaft driving gear and a crankshaft driving gear retaining structure. The oil pump comprises a pump body, an oil pump shaft and an oil pump driving gear, wherein the pump body is integrated with the engine end cover, and the oil pump driving gear is connected to the oil pump shaft. The crankshaft driving gear is rotatably arranged on the engine end cover and externally meshes with the oil pump driving gear.

13 Claims, 5 Drawing Sheets

(58) Field of Classification Search
CPC ..... F01M 2001/0284; F04C 2/08; F04C 2/10; F04C 15/0061
See application file for complete search history.

(56) References Cited

U.S. PATENT DOCUMENTS

| | | | | |
|---|---|---|---|---|
| 6,241,016 | B1 * | 6/2001 | Dedels | F04C 15/0061 418/206.1 |
| 2010/0012075 | A1 * | 1/2010 | Bluhm | F01M 1/02 123/196 R |
| 2010/0122870 | A1 * | 5/2010 | Fonville | F02B 77/13 181/294 |
| 2010/0189582 | A1 * | 7/2010 | Mitchell | F01C 21/02 418/9 |
| 2018/0294692 | A1 * | 10/2018 | Sato | H02K 7/116 |

FOREIGN PATENT DOCUMENTS

| | | | |
|---|---|---|---|
| CN | 114294071 | A | 4/2022 |
| CN | 114396330 | A | 4/2022 |
| JP | 2016023554 | A | 2/2016 |

* cited by examiner

ENGINE END COVER INTEGRATED OIL PUMP ASSEMBLY

TECHNICAL FIELD

The invention relates to vehicle engine lubrication techniques, in particular to an oil pump technique.

DESCRIPTION OF RELATED ART

Traditional crankshaft direct-drive oil pumps have a large size and weight, and an oil pump body and a pump cover around a crankshaft cannot be locked with bolts. The rise of the oil temperature and pressure will lead to an increase of axial deformation of the pump body and the pump cover, and end clearances between a rotor or a gear in the pump and the pump body and the pump cover will become larger, worsening internal leaking and external leaking of the oil pump, increasing oil consumption of the oil pump, and reducing the working efficiency of the oil pump.

In addition, because the drive ratio between an engine crankshaft and a pump shaft of traditional crankshaft direct-drive oil pumps is 1:1, the traditional crankshaft direct-drive oil pumps cannot be always maintained in the optimal condition when working together with diesel engines with a rotational speed of 0 rpm-2200 rpm, thus compromising the working efficiency of the oil pumps.

At present, some manufacturers propose the design scheme of an engine end cover integrated oil pump assembly, which comprises an engine end cover and an oil pump, wherein the oil pump comprises a pump body, an oil pump shaft and an oil pump driving gear, the pump body is integrated with the engine end cover, and the oil pump driving gear is connected to the oil pump shaft and meshes with a crankshaft driving gear mounted on an engine crankshaft to receive the torque output by the engine crankshaft. In this scheme, a crankshaft direct-drive oil pump is transformed into an indirect-drive oil pump by means of gear drive. However, because the crankshaft driving gear is generally press-fitted on the engine crankshaft in an interference manner, it is difficult to align the oil pump driving gear of the oil pump with the crankshaft driving gear on the crankshaft during assembly, compromising assembly efficiency.

BRIEF SUMMARY OF THE INVENTION

The technical issue to be settled by the invention is to provide an engine end cover integrated oil pump assembly, which solves the problem that it is difficult to align a crankshaft driving gear connected to an engine crankshaft with an oil pump driving gear of an oil pump, can be easily assembled on the engine crankshaft, and can realize high working efficiency of the oil pump.

The embodiments of the invention provide an engine end cover integrated oil pump assembly, comprising an engine end cover and an oil pump, the oil pump comprising a pump body, an oil pump shaft and an oil pump driving gear, the pump body being integrated with the engine end cover, the oil pump driving gear being connected to the oil pump shaft, and the engine end cover being provided with an end cover through-hole allowing an engine crankshaft to penetrate through, wherein the engine end cover integrated oil pump assembly comprises a crankshaft driving gear and a crankshaft driving gear retaining structure; the crankshaft driving gear is rotatably arranged on the engine end cover and externally meshes with the oil pump driving gear; the crankshaft driving gear is provided with a shaft hole allowing the engine crankshaft to penetrate through, the shaft hole exactly faces the end cover through-hole, and the crankshaft driving gear is provided with a shaft connection structure, which is used for connecting the engine crankshaft to enable the crankshaft driving gear to rotate synchronously with the engine crankshaft; the crankshaft driving gear retaining structure is used for retaining the crankshaft driving gear on the engine end cover to prevent the crankshaft driving gear from falling off from the engine end cover.

According to the engine end cover integrated oil pump assembly, wherein the crankshaft driving gear and the oil pump driving gear have a drive ratio allowing the rotational speed V of the oil pump to satisfy: 1000 rpm≤V≤4000 rpm when the rotational speed of the engine crankshaft is 900 rpm-1500 rpm.

According to the engine end cover integrated oil pump assembly, wherein the oil pump comprises a pump cover, and the pump cover is close to an inner side of the engine end cover and is detachably connected to the pump body through a plurality of fasteners.

According to the engine end cover integrated oil pump assembly, wherein the oil pump is a variable-displacement oil pump, which comprises a proportional solenoid valve or a switching type solenoid valve, an inlet of the proportional solenoid valve or the switching type solenoid valve is connected to a main oil passage of an engine lubrication system, and an outlet of the proportional solenoid valve or the switching type solenoid valve is connected to a feedback cavity of the variable-displacement oil pump.

The engine end cover integrated oil pump assembly according to the embodiments of the invention has the following advantages:

1. In the embodiments of the invention, the crankshaft driving gear connected to the engine crankshaft and the oil pump driving gear of the oil pump are both integrated on the engine end cover and mesh with each other, such that the difficulty in gear alignment caused by separate assembly of the crankshaft driving gear and the oil pump driving gear is overcome; the crankshaft driving gear can be quickly assembled on the engine crankshaft through the shaft connection structure, such that assembly is easy;
2. In the embodiments of the invention, the crankshaft driving gear retaining structure is arranged to retain the crankshaft driving gear on the engine end cover, such that the crankshaft driving gear is prevented from falling off in presence of vibrations during transportation;
3. In the embodiments of the invention, the oil pump is integrated on the engine end cover, such that the size of the oil pump is reduced; the pump cover and the oil pump are firmly connected through fasteners, such that oil leaking is avoided, power consumption of the oil pump is reduced, and the working efficiency of the oil pump is improved, thus improving the heat efficiency of an engine and reducing the overall weight;
4. By designing the drive ratio between the crankshaft driving gear and the oil pump driving gear, the problems of low revolutions and narrow variable adjustment range of crankshaft direct-drive oil pumps of diesel engines and failure to make full use of the variable-displacement advantage of the variable-displacement oil pump are solved, the variable adjustment range is expanded to realize oil supply as required and reduce power losses, thus saving oil and reducing emission. For large-toque and low-speed engines with a rotational speed less than 2200 rpm, the rotational speed of the oil pump is allowed to change between 1000 rpm and 4000 rpm by gear drive in the embodiments of the invention when the rotational speed of the engine crankshaft is 900 rpm-1500 rpm, to enable the oil pump to operate within the optimal working efficiency range, thus realizing the optimal working efficiency of the oil pump;

5. In the embodiments of the invention, the proportional solenoid valve or the switching type solenoid valve is used to control the displacement of the variable-displacement oil pump to realize oil supply as required, thus saving energy and reducing consumption.

BRIEF DESCRIPTION OF THE SEVERAL VIEWS OF DRAWINGS

The invention will be further described below in conjunction with accompanying drawings.

PREFERRED EMBODIMENT OF THE INVENTION

Figure 5:
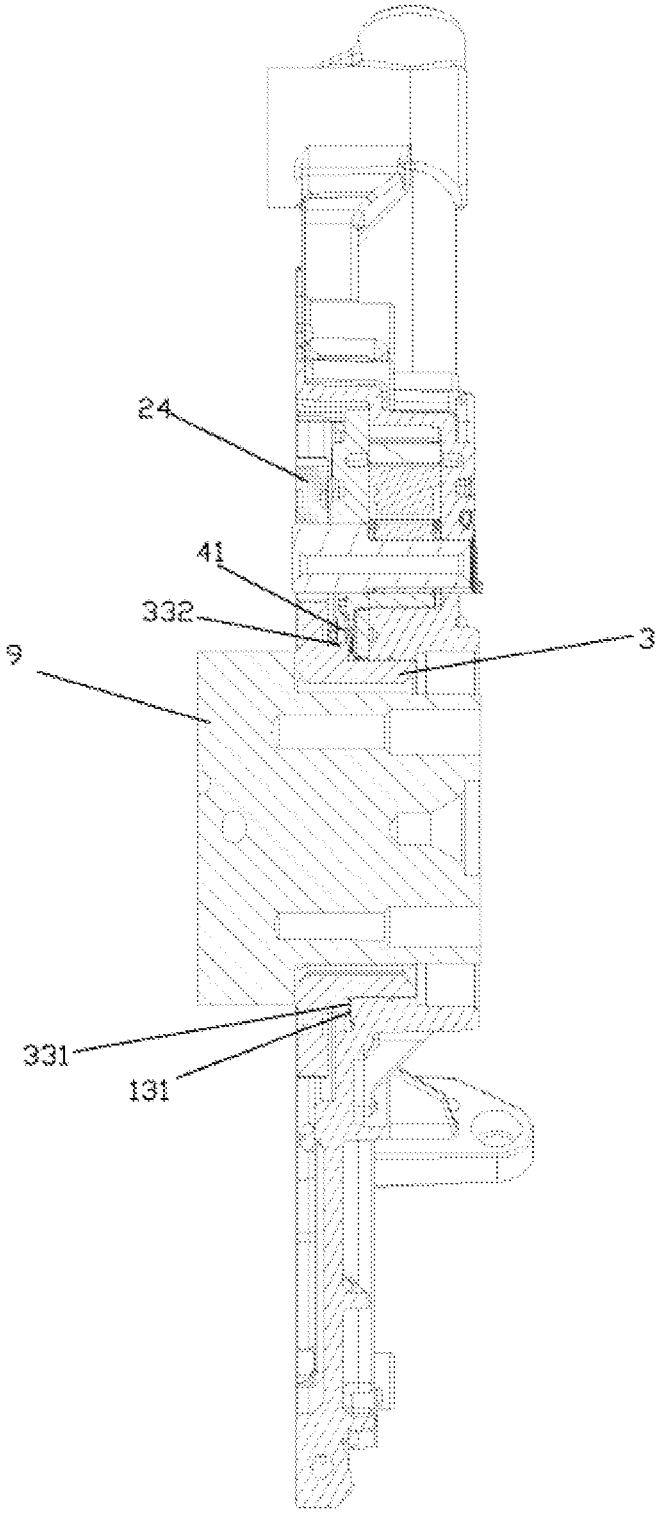
FIG. 5 is an assembly diagram of the engine end cover integrated oil pump assembly and an engine crankshaft according to one embodiment of the invention.

FIG. 1-FIG. 4 respectively illustrate structural views of an engine end cover integrated oil pump assembly according to one embodiment of the invention. FIG. 5 illustrates an assembly diagram of the engine end cover integrated oil pump assembly and an engine crankshaft according to one embodiment of the invention. Referring to FIG. 1-FIG. 5, according to one embodiment of the invention, an engine end cover integrated oil pump assembly comprises an engine end cover 1, an oil pump 2, a crankshaft driving gear 3 and a crankshaft driving gear retaining structure.

The oil pump 2 comprises a pump body 21, a pump cover 22, an oil pump shaft 23 and an oil pump driving gear 24. The pump body 21 is integrated with the engine end cover 1. In this embodiment, the pump body 21 and the engine end cover 1 are formed integrally, and part of the engine end cover 1 is used as the pump body 21 of the oil pump, thus reducing the overall weight of the engine end cover integrated oil pump assembly. The pump cover 22 is close to an inner side of the engine end cover 1 and is detachably connected to the pump body 21 through a plurality of fasteners (in this embodiment, the fasteners are first bolts 81). In this specification, the inner side of the engine end cover 1 is a side close to the inside of an engine, and an outer side of the engine end cover 1 is a side close to the outside of the engine. One end of the oil pump shaft 23 penetrates through the pump cover 22, and the oil pump driving gear 24 is mounted at this end of the oil pump shaft 23 to drive the oil pump shaft 23 to rotate synchronously.

The pump body 21 is provided with a mounting through-hole 210 penetrating through the outer side of the engine end cover, and the other end of the oil pump shaft 23 is rotatably inserted into the mounting through-hole 210. When the oil pump driving gear 24 is press-fitted on the oil pump shaft 23 in an interference manner, the oil pump shaft 23 can be supported axially by means of the mounting through-hole 210, thereby realizing interference press-fitting of the oil pump driving gear.

Further, the oil pump 2 comprises a mounting through-hole sealing structure, which comprises a sealing cover 25, a sealing ring 26 and an annular sealing groove 27 formed in the outer side of the engine end cover. The annular sealing groove 27 encircles the mounting through-hole 210. The sealing cover 25 comprises a cover body 251, an annular flange 252 radially extending outwards from the periphery of a bottom end of a side wall of the cover body 251, and an annular turnup 253 bent towards the top from the periphery of an outer side of the annular flange 252. A top wall 2511 of the cover body 251 covers the mounting through-hole 210, a side wall 2512 of the cover body 251 extends into the annular sealing groove 27, and the annular turnup 253 is in interference fit with an outer side of the annular sealing groove 27, such that the sealing ring 26 is pressed by the side wall 2512 of the cover body against an inner side of the annular sealing groove 27, thus realizing a sealing effect. Optionally, a vertical section of the annular flange 252 is wavy, and the wavy structure can improve elasticity. In a specific implementation, the sealing cover 25 is made from stainless steel.

Figure 1:
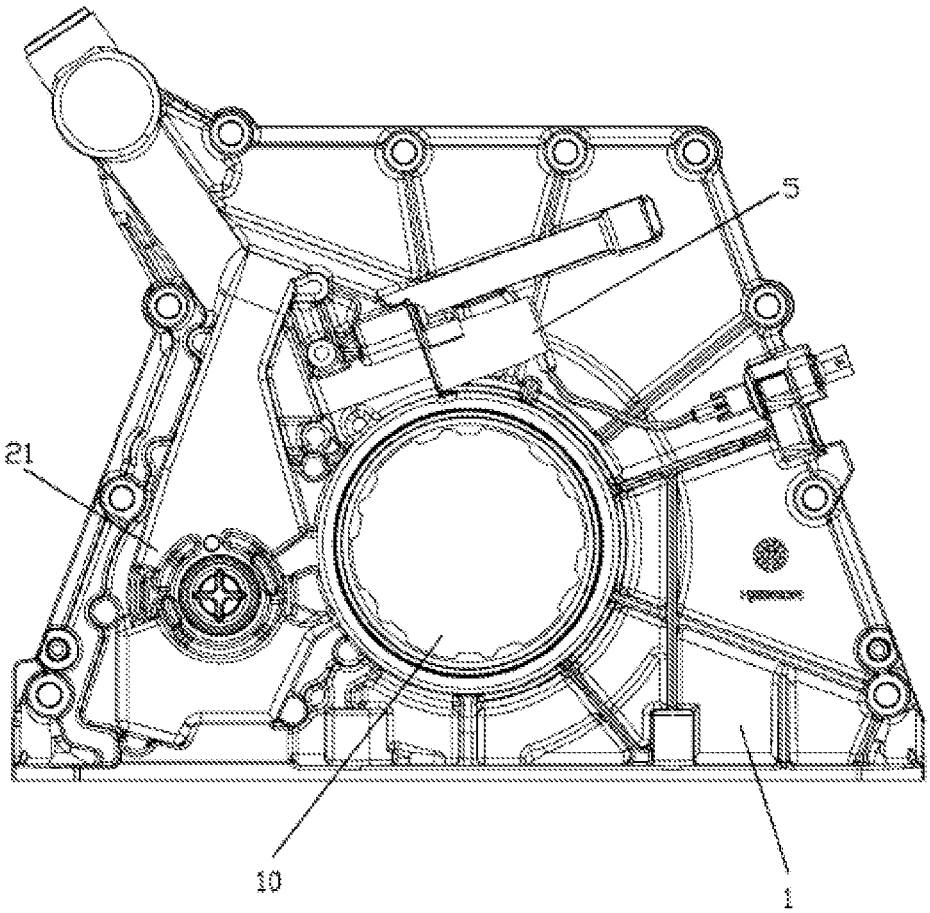
FIG. 1 illustrates a front view of an engine end cover integrated oil pump assembly according to one embodiment of the invention.
Figure 2:
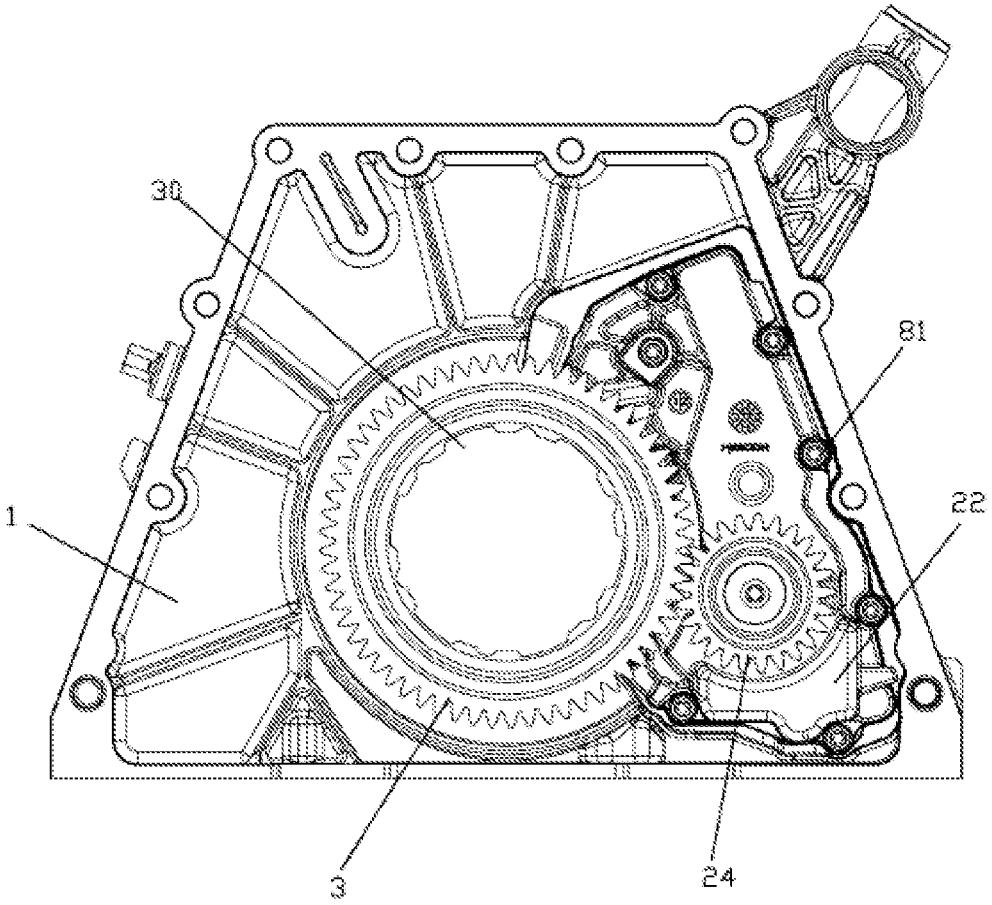
FIG. 2 is a back view of the engine end cover integrated oil pump assembly according to one embodiment of the invention.
Figure 3:
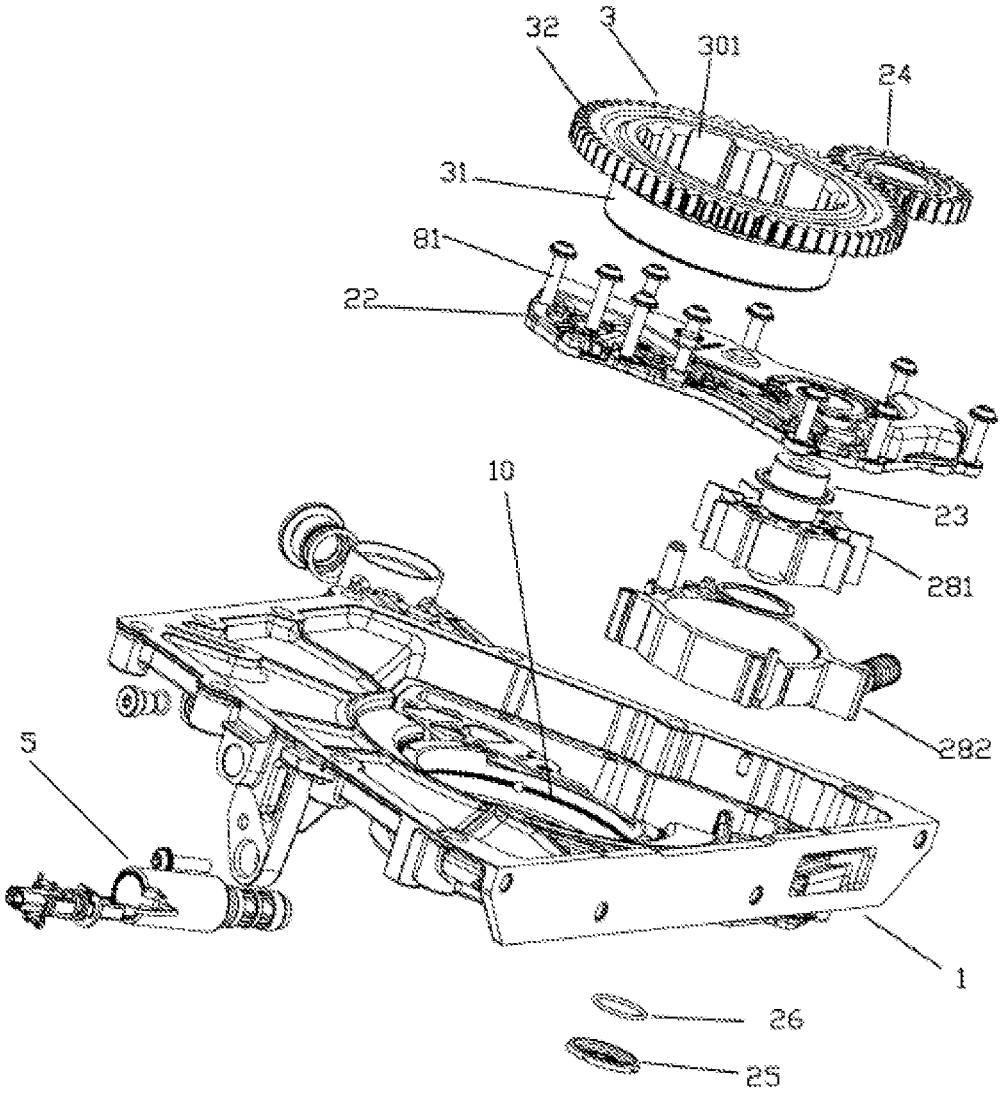
FIG. 3 is an exploded view of the engine end cover integrated oil pump assembly according to one embodiment of the invention.
Figure 4:
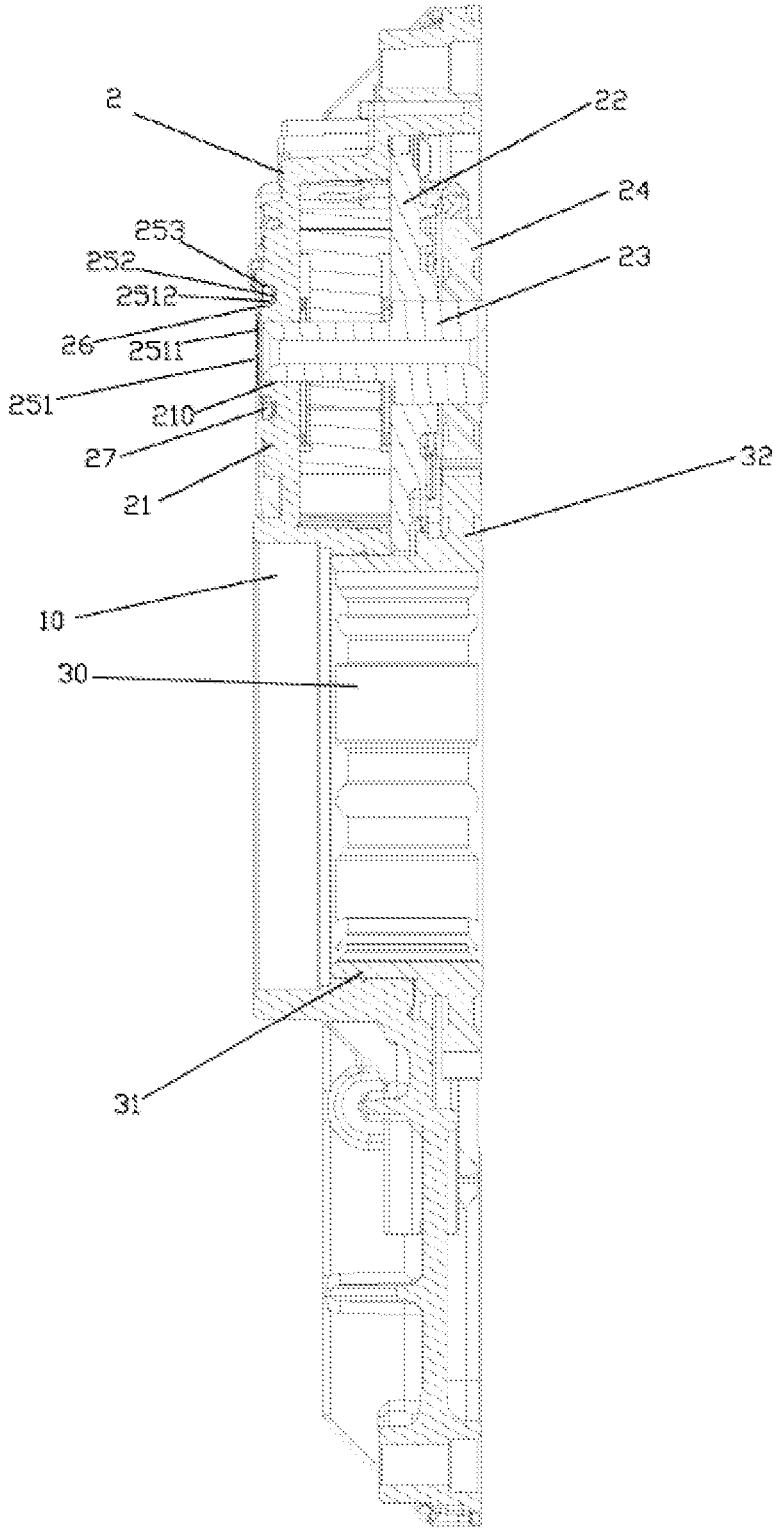
FIG. 4 is a sectional view of the engine end cover integrated oil pump assembly according to one embodiment of the invention.

In this embodiment, the oil pump 1 is a vane pump, and vanes 281, an eccentric ring 282 and other parts of the vane pump are shown in FIG. 3. In other embodiments, the oil pump 1 may be a cycloid rotor pump, a gear pump, a pendulum type sliding vane pump, a hinged vane pump (the hinged vane pump does not belong to traditional vane pumps), or the like.

The engine end cover 1 is provided with an end cover through-hole 10 allowing the engine crankshaft 9 to penetrate through. The crankshaft driving gear 3 is rotatably arranged on the engine end cover 1 and externally meshes with the oil pump driving gear 24. The crankshaft driving gear 3 is provided with a shaft hole 30 allowing the engine crankshaft 9 to penetrate through, and the shaft hole 30 exactly faces the end cover through-hole 10.

In this embodiment, the crankshaft driving gear 3 comprises a gear shaft 31 and a gear plate 32, one end of the gear shaft 31 is rotatably inserted into the end cover through-hole 10, and the gear plate 32 is connected to the other end of the gear shaft 31 and externally meshes with the oil pump driving gear 24. The gear shaft 31 is provided with a central through-hole which extends axially, and the central through-hole forms the shaft hole 30.

The crankshaft driving gear 3 is also provided with a shaft connection structure, which is used for connecting the engine crankshaft 9 to enable the crankshaft driving gear 3 to rotate synchronously with the engine crankshaft 9. In this embodiment, the shaft connection structure is a spline groove 301 formed in an inner wall of the shaft hole 30, and the crankshaft driving gear 3 is in clearance fit with the engine crankshaft 9 through a spline, thus making assembly easy. In other embodiments, the shaft connection structure may be a spline arranged on the inner wall of the shaft hole 30.

The crankshaft driving gear retaining structure is used for retaining the crankshaft driving gear 3 on the engine end cover 1 to prevent the crankshaft driving gear 3 from falling off from the engine end cover 1 due to vibration and other reasons during transportation.

The crankshaft driving gear retaining structure comprises a first axial limiting structure and a second axial limiting structure, wherein the first axial limiting structure is arranged between the crankshaft driving gear 3 and the engine end cover 1 and is used for limiting an axial movement of the crankshaft driving gear towards the outer side of the engine end cover, and the second axial limiting structure is arranged between the crankshaft driving gear 3 and the engine end cover 1 and is used for limiting an axial movement of the crankshaft driving gear towards the inner side of the engine end cover.

Further, the first axial limiting structure comprises a first limiting portion arranged on the crankshaft driving gear 3 and a second limiting portion arranged on the engine end cover 1 and matched with the first limiting portion, the second axial limiting structure comprises a third limiting portion arranged on the crankshaft driving gear 3 and a fourth limiting portion arranged on the engine end cover 1 and matched with the third limiting portion, and the engine crankshaft 9 is provided with a fifth limiting portion matched with the crankshaft driving gear 3 to prevent the crankshaft driving gear 3 from moving towards the inner side of the engine end cover. When the crankshaft driving gear 3 is assembled on the engine crankshaft 9, the fifth limiting portion is matched with the crankshaft driving gear 3 to maintain a gap between the third limiting portion and the fourth limiting portion, such that the third limiting portion and the fourth limiting portion will not be in contact, thus preventing the crankshaft driving gear retaining structure from interfering with the rotation of the crankshaft driving gear.

In this embodiment, the first axial limiting structure comprises a first step surface 331 (the first limiting portion mentioned above) arranged on the crankshaft driving gear 3 and a stop surface 131 (the second limiting portion mentioned above) arranged on the engine end cover 1, and the stop surface 131 abuts against the first step surface 331 to prevent the crankshaft driving gear 3 from moving axially towards the outer side of the engine end cover. The second axial limiting structure comprises a second step surface 332 (the third limiting portion mentioned above) arranged on the crankshaft driving gear 3 and an elastic stop piece (the fourth limiting portion mentioned above) arranged on the engine end cover 1, one end of the elastic stop piece 41 is fixed to the engine end cover 1 through bolts, the other end of the elastic stop piece 41 is hook-like and exactly faces the second step surface 332, and a gap is reserved between the other end of the elastic stop piece 41 and the second step surface 332. The crankshaft driving gear can be assembled more easily by means of the elastic stop piece, and normal operation of the engine will not be disturbed by the elastic stop piece.

In this embodiment, the fifth limiting portion is a shoulder of the engine crankshaft 9. When the engine end cover integrated oil pump assembly is mounted on the engine crankshaft 9, the shoulder of the engine crankshaft 9 abuts against an end face of the crankshaft driving gear 3 (a left end face of the crankshaft driving gear 3 in FIG. 5) to limit the axial movement of the crankshaft driving gear 3 towards the inner side of the engine end cover and prevent the other end of the elastic stop piece 41 from making contact with the second step surface 332, such that the crankshaft driving gear retaining structure will not interfere with the rotation of the crankshaft driving gear.

In another implementation, the second axial limiting structure may also be configured as follows: the elastic stop piece is fixed to the end face of the crankshaft driving gear 3 through bolts, and a step-shaped stop portion matched with the elastic stop piece is arranged on a wall of the end cover through-hole 10 of the engine end cover.

In another implementation, the crankshaft driving gear retaining structure may adopt a small step for interference fit, the crankshaft driving gear is placed in the end cover through-hole 10 after being frozen, and after returning to normal temperature, the crankshaft driving gear will be buckled to be prevented from becoming loose axially.

When the oil pump assembly is transported and before the oil pump assembly is assembled on the engine crankshaft, the crankshaft driving gear retaining structure in this embodiment can prevent the crankshaft driving gear from falling off from the engine end cover; and after the oil pump assembly is assembled on the engine crankshaft, the crankshaft driving gear retaining structure does not need to be disassembled and will not interfere with the operation of the crankshaft driving gear.

In a specific implementation, the crankshaft driving gear 3 and the oil pump driving gear 24 have a drive ratio allowing the rotational speed V of the oil pump 1 to satisfy: 1000 rpm≤V≤4000 rpm when the rotational speed of the engine crankshaft 9 is 900 rpm-1500 rpm, because the inventor finds in practice that the overall efficiency is optimal when the rotational speed of the oil pump is 1000 rpm-4000 rpm. For diesel engines with a low rotational speed, the rotational speed of the oil pump is allowed to change between 1000 rpm and 4000 rpm by gear drive when the rotational speed of the engine crankshaft is 900 rpm-1500 rpm, to enable the oil pump to operate within the optimal working efficiency range, thus realizing the optimal working efficiency of the oil pump.

In a specific implementation, the oil pump 1 is a variable-displacement oil pump, which comprises a proportional solenoid valve 5, wherein an inlet of the proportional solenoid valve 5 is connected to a main oil passage of an engine lubrication system, and an outlet of the proportional solenoid valve 5 is connected to a feedback cavity of the variable-displacement oil pump. The displacement of the variable-displacement oil pump can be controlled by the proportional solenoid valve, such that oil can be supplied as required, thus saving energy and reducing consumption. In other implementations, the proportional solenoid valve may be replaced with a switching type solenoid valve.

According to the oil pump assembly in this embodiment, the crankshaft driving gear, the oil pump and the engine end cover are integrated. Compared with traditional crankshaft direct-drive oil pump assemblies, the weight of the oil pump assembly in this embodiment is reduced by about 10%-20%. Compared with traditional crankshaft direct-drive oil pump assemblies adopting an involute circular tooth gear or a cycloid rotor pump, the overall efficiency of the oil pump can be improved by over 40%. Compared with traditional crankshaft direct-drive oil pump assemblies adopting a variable-displacement vane pump, the overall efficiency of the oil pump can be improved by over 10%, and more than 1 g of fuel oil can be saved per kilowatt hour.

INDUSTRIAL APPLICABILITY

According to the engine end cover integrated oil pump assembly provided by the embodiments of the invention, the crankshaft driving gear connected to the engine crankshaft and the oil pump driving gear of the oil pump are both integrated on the engine end cover, such that the difficulty in gear alignment caused by separate assembly of the crankshaft driving gear and the oil pump driving gear is overcome, and the working efficiency of the oil pump is improved.

What is claimed is:

1. An engine end cover integrated oil pump assembly, comprising an engine end cover and an oil pump, the oil pump comprising a pump body, an oil pump shaft and an oil pump driving gear, the pump body being integrated with the engine end cover, the oil pump driving gear being connected to the oil pump shaft, and the engine end cover being provided with an end cover through-hole allowing an engine crankshaft to penetrate through, wherein the engine end cover integrated oil pump assembly comprises a crankshaft driving gear and a crankshaft driving gear retaining structure;

the crankshaft driving gear is rotatably arranged on the engine end cover and externally meshes with the oil pump driving gear; the crankshaft driving gear is provided with a shaft hole allowing the engine crankshaft to penetrate through, the shaft hole exactly faces the end cover through-hole, and the crankshaft driving gear is provided with a shaft connection structure, which is used for connecting the engine crankshaft to enable the crankshaft driving gear to rotate synchronously with the engine crankshaft;

the crankshaft driving gear retaining structure is used for retaining the crankshaft driving gear on the engine end cover to prevent the crankshaft driving gear from falling off from the engine end cover.

2. The engine end cover integrated oil pump assembly according to claim 1, wherein the crankshaft driving gear comprises a gear shaft and a gear plate, one end of the gear shaft is rotatably inserted into the end cover through-hole, and the gear plate is connected to the other end of the gear shaft and externally meshes with the oil pump driving gear;

the gear shaft is provided with a central through-hole which extends axially, and the central through-hole forms the shaft hole.

3. The engine end cover integrated oil pump assembly according to claim 1, wherein the crankshaft driving gear retaining structure comprises a first axial limiting structure and a second axial limiting structure, the first axial limiting structure is arranged between the crankshaft driving gear and the engine end cover and is used for limiting an axial movement of the crankshaft driving gear towards an outer side of the engine end cover, and the second axial limiting structure is arranged between the crankshaft driving gear and the engine end cover and is used for limiting an axial movement of the crankshaft driving gear towards an inner side of the engine end cover.

4. The engine end cover integrated oil pump assembly according to claim 3, wherein either the first axial limiting structure or the second axial limiting structure comprises an elastic stop piece and a stop portion matched with the elastic stop piece.

5. The engine end cover integrated oil pump assembly according to claim 3, wherein the first axial limiting structure comprises a first step surface arranged on the crankshaft driving gear and a stop surface arranged on the engine end cover, and the stop surface abuts against the first step surface to prevent the crankshaft driving gear from moving axially towards the outer side of the engine end cover;

the second axial limiting structure comprises a second step surface arranged on the crankshaft driving gear and an elastic stop piece arranged on the engine end cover, one end of the elastic stop piece is connected to the engine end cover, the other end of the elastic stop piece is hook-like and exactly faces the second step surface, and a gap is reserved between the other end of the elastic stop piece and the second step surface.

6. The engine end cover integrated oil pump assembly according to claim 3, wherein the first axial limiting structure comprises a first limiting portion arranged on the crankshaft driving gear and a second limiting portion arranged on the engine end cover and matched with the first limiting portion, the second axial limiting structure comprises a third limiting portion arranged on the crankshaft driving gear and a fourth limiting portion arranged on the engine end cover and matched with the third limiting portion, and the engine crankshaft is provided with a fifth limiting portion matched with the crankshaft driving gear to prevent the crankshaft driving gear from moving towards the inner side of the engine end cover;

when the crankshaft driving gear is assembled on the engine crankshaft, the fifth limiting portion is matched with the crankshaft driving gear to maintain a gap between the third limiting portion and the fourth limiting portion.

7. The engine end cover integrated oil pump assembly according to claim 1, wherein the shaft connection structure is a spline groove or a spline arranged on an inner wall of the shaft hole.

8. The engine end cover integrated oil pump assembly according to claim 1, wherein the crankshaft driving gear and the oil pump driving gear have a drive ratio allowing a rotational speed V of the oil pump to satisfy: 1000 rpm≤V≤4000 rpm when a rotational speed of the engine crankshaft is 900 rpm-1500 rpm.

9. The engine end cover integrated oil pump assembly according to claim 1, wherein the oil pump comprises a pump cover, and the pump cover is close to an inner side of the engine end cover and is detachably connected to the pump body through a plurality of fasteners;

one end of the oil pump shaft penetrates through the pump cover, and the oil pump driving gear is mounted at said end of the oil pump shaft.

10. The engine end cover integrated oil pump assembly according to claim 9, wherein the pump body is provided with a mounting through-hole penetrating through an outer side of the engine end cover, and the other end of the oil pump shaft is rotatably inserted into the mounting through-hole;

the oil pump comprises a mounting through-hole sealing structure, which comprises a sealing cover, a sealing ring and an annular sealing groove formed in the outer side of the engine end cover;

the annular sealing groove encircles the mounting through-hole; the sealing cover comprises a cover body, an annular flange radially extending outwards from a periphery of a bottom end of a side wall of the cover body, and an annular turnup bent towards a top from a periphery of an outer side of the annular flange; a top wall of the cover body covers the mounting through-hole, a side wall of the cover body extends into the annular sealing groove, and the annular turnup is in interference fit with an outer side of the annular sealing groove, such that the sealing ring is pressed by the side wall of the cover body against an inner side of the annular sealing groove.

11. The engine end cover integrated oil pump assembly according to claim 10, wherein a vertical section of the annular flange is wavy.

12. The engine end cover integrated oil pump assembly according to claim 1, wherein the oil pump is a variable-displacement oil pump, which comprises a proportional solenoid valve or a switching type solenoid valve, an inlet of the proportional solenoid valve or the switching type solenoid valve is connected to a main oil passage of an engine lubrication system, and an outlet of the proportional solenoid valve or the switching type solenoid valve is connected to a feedback cavity of the variable-displacement oil pump.

13. The engine end cover integrated oil pump assembly according to claim 1, wherein the oil pump is a vane pump, a cycloid rotor pump, a gear pump, a pendulum type sliding vane pump or a hinged vane pump.

* * * * *